US009774150B2

(12) United States Patent
Shea et al.

(10) Patent No.: US 9,774,150 B2
(45) Date of Patent: Sep. 26, 2017

(54) RV LIGHTING CONNECTOR

(71) Applicants: Stacey Shea, Goldendale, WA (US); James Kandler, Goldendale, WA (US)

(72) Inventors: Stacey Shea, Goldendale, WA (US); James Kandler, Goldendale, WA (US)

( * ) Notice: Subject to any disclaimer, the term of this patent is extended or adjusted under 35 U.S.C. 154(b) by 0 days.

(21) Appl. No.: 15/001,836

(22) Filed: Jan. 20, 2016

(65) Prior Publication Data

US 2017/0207586 A1 Jul. 20, 2017

(51) Int. Cl.
*H01R 33/00* (2006.01)
*H01R 13/717* (2006.01)
*H01H 21/18* (2006.01)

(52) U.S. Cl.
CPC ..... *H01R 13/7175* (2013.01); *H01H 21/18* (2013.01); *H01H 2231/026* (2013.01)

(58) Field of Classification Search
CPC ..... H01R 13/7175; H01H 21/18; H01H 2231/026
USPC ..... 439/36, 34, 100, 76.2
See application file for complete search history.

(56) References Cited

U.S. PATENT DOCUMENTS

2015/0364851 A1* 12/2015 Levante ..... H01R 13/502 362/640

* cited by examiner

*Primary Examiner* — Javaid Nasri
(74) *Attorney, Agent, or Firm* — The Law Office of Jerry D. Haynes

(57) ABSTRACT

A RV plug connector for supplying exterior lighting that includes: a lid; a connector module, where the connector module is beneath the lid and provides a plurality of connectors related to RV lighting; a plug, where the plug connects to a 12V DC adapter; an external connector, where the external connector provides an outlet for any additional lighting; and a LED light above the lid, where the LED light illuminates the plug connector. The plurality of connectors may include a battery connector, a ground connector, a left turn and brake light connector or a tail and running light connector. The RV plug connector may also include a toggle switch, where the toggle switch activates lighting associated with the plurality of connectors.

6 Claims, 4 Drawing Sheets

RV LIGHTING CONNECTOR

BACKGROUND OF THE INVENTION

Field of Invention

The present invention relates to RV plug connector that enables exterior lighting for a RV trailer or camper.

Description of Related Art

Many individuals enjoy camping through the use of camping trailers and recreational vehicles. Many times these RVs or camping trailers are set up at a campsite with limited exterior light. This limited lighting is occasionally addressed with a small exterior, but limited, light on the RV. However in most applications such conventional lighting is insufficient to provide proper illumination for operation around and near the RV. As a result, it would be advantageous to have an additional means to provide exterior lighting for RV, camper or a trailer where the user may implement lighting associated with the trailer. Many times the RV vehicle or camper trailer includes operational lights such as brake lights, taillights and turn signals. This additional lighting although primarily used during transportation could advantageously provide further illumination of the campsite if effectively activated through the use of a specialized connector.

SUMMARY OF THE INVENTION

The present invention relates to a RV plug connector for supplying exterior lighting that includes: a lid; a connector module, where the connector module is beneath the lid a and provides a plurality of connectors related to RV lighting; a plug, where the plug connects to a 12V DC adapter; an external connector, where the external connector provides an outlet for any additional lighting; and a LED light above the lid, where the LED light illuminates the plug connector. The plurality of connectors may include a battery connector, a ground connector, a left turn and brake light connector or a tail and running light connector. The RV plug connector may also include a toggle switch, where the toggle switch activates lighting associated with the plurality of connectors.

DETAILED DESCRIPTION

The present invention relates to a RV plug connector that provides exterior lighting for a RV or camper trailer. The present invention connects and activates exterior lighting associated with the RV camper to provide additional lighting at night for the user. The RV plug connector according to present invention includes a connection module that has a series or multiple connectors associated with lighting normally found on a RV camper. The connector further includes a toggle switch that activates the lighting connected through the plug connector. Further the plug connector includes an external connector having 12-volt and ground openings so that a user may directly connect to the plug connector. The connector module is preferably covered by a lid that opens and closes to expose the connectors for activation of the various exterior lighting. The exterior lighting associated with the plug connection preferably relates to tail or running lights, turn signals and brake lights that are normally provided on a RV camper.

Figure 1:
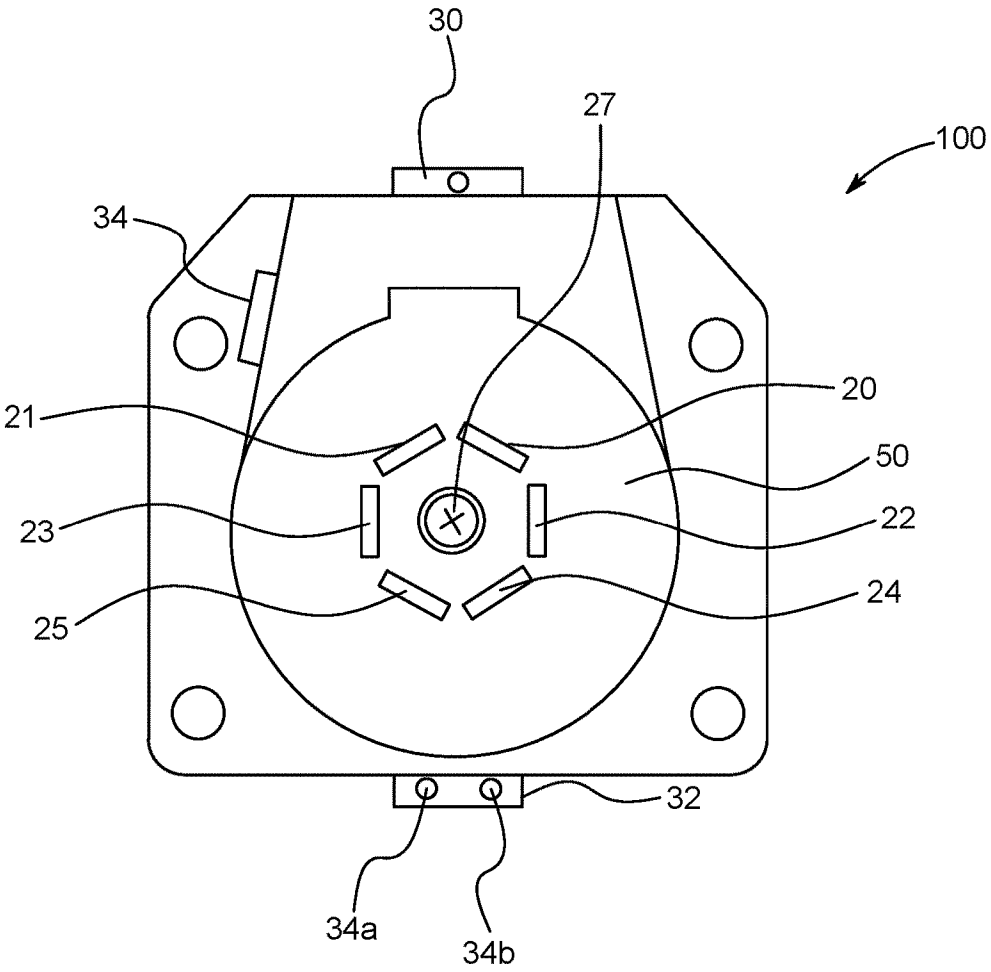
FIG. 1 takes a schematic view of a connection module used in accordance with the present invention.

In reference to FIG. 1, a schematic of a plug connector 100 is depicted. Plug connector 100 includes a LED locator 30 at the top of the plug connector 100. At the center of the plug connector 100 is a series of connectors associated with exterior lighting and other electronic components of the RV camper within a connection module 50. The connection module 50 is shown in a circle formation with a center connection provided for a reverse-light 27. Normally this reverse-light connector 27 is not used for illumination purposes but provides an alternative for the user. Further other connectors not specifically used include a right-turn and brake light connector 22 and a brake controller output 24. Other connectors provided in the connection module 50, include tail and running lights connector 21, battery power connector 20, ground connector 25 and a left-turn and brake connector 23. Further a connector for the tail and running lights 21 is also provided within the connection module 50. Other features of the plug connector 100 include a toggle switch 34 shown in FIGS. 1, 2 and 3. The toggle switch 34 enables the user to toggle or turn on the lighting associated with the connection module 50. Also shown is an external connector 32 which provides external connecting includes two female openings, 12-volt power 34*a* and ground 34*b*.

Figure 2:
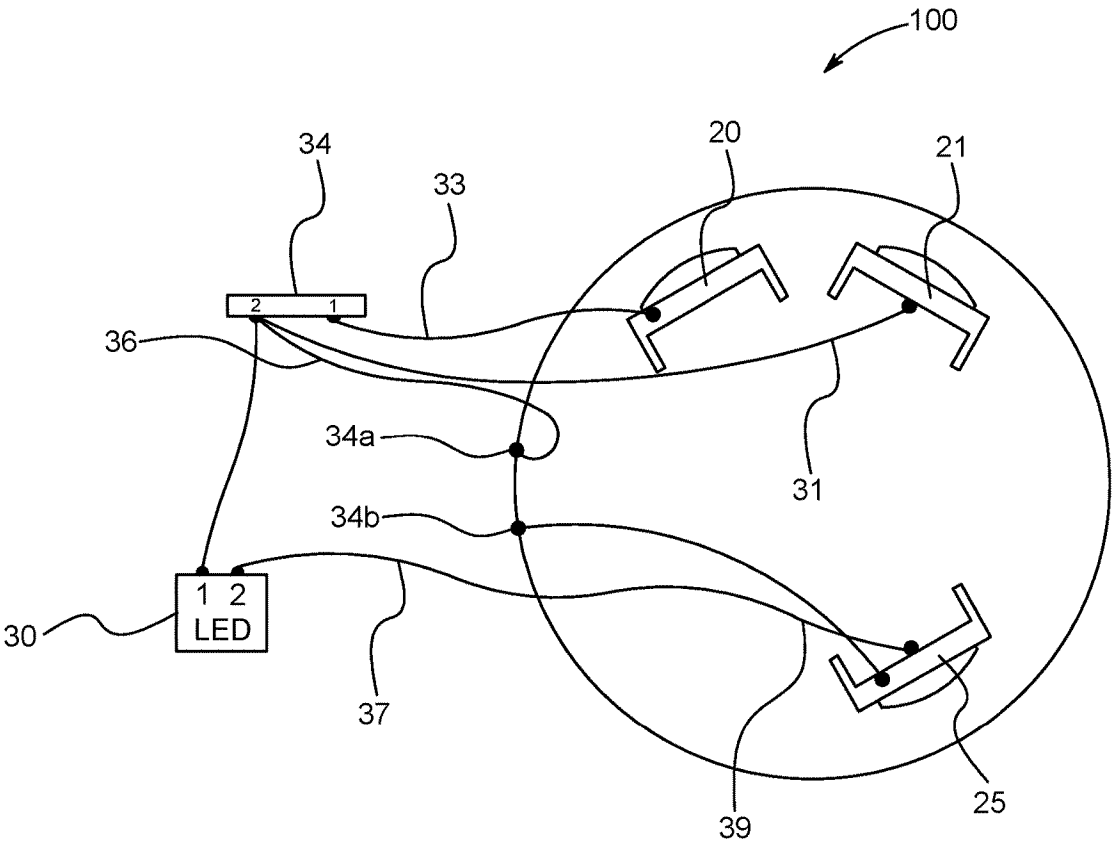
FIG. 2 depicts a view of a plug and wiring associated with the present invention.

FIG. 2 provides a view of the plug connector 100 that shows the wiring connection for the associated lighting. As shown, battery power is provided through connector 20, which aligns with the toggle switch 34 through wire 33. Tail and running light 21 connects to the toggle switch 34 through wire 31. External connector 32 extends from the toggle switch 34 through wire 36. The ground connector 25 extends to the LED light 30 and to the external connector 32 through wires 37 and wire 39 respectively. A lead is also provided for a connection between toggle switch 34 and LED light 30 as shown in FIG. 2.

Figure 3:
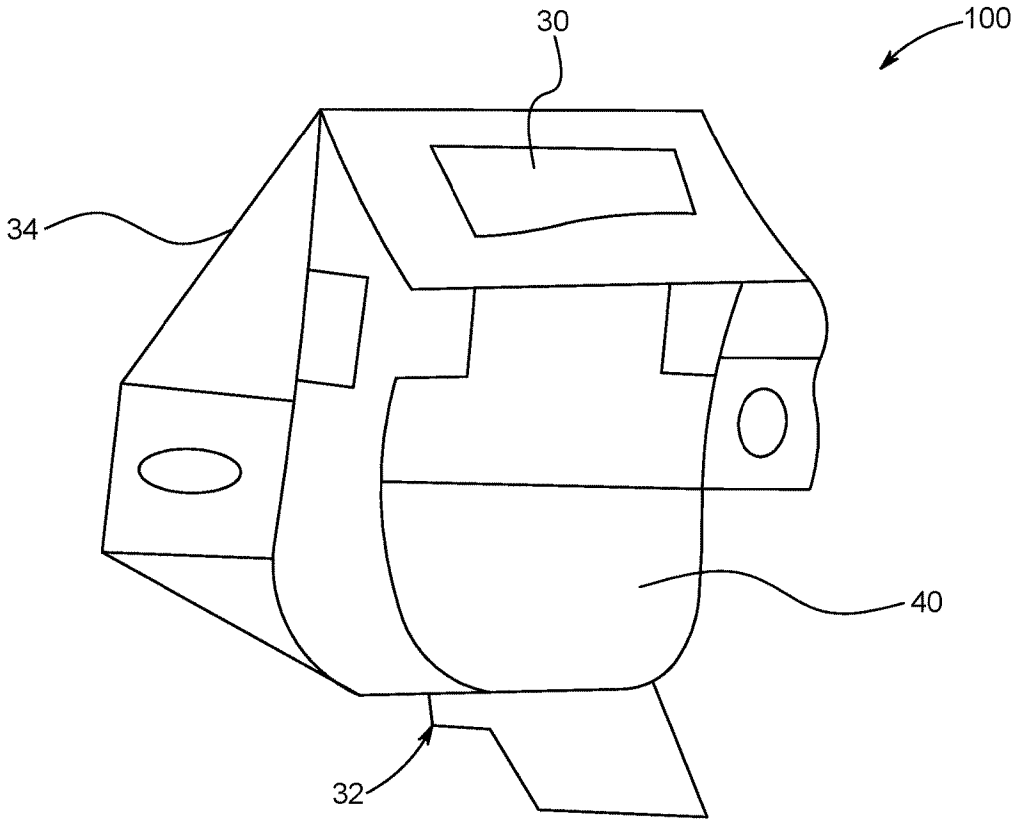
FIG. 3 depicts a perspective view of a plug connector in accordance with the present invention.
Figure 4:
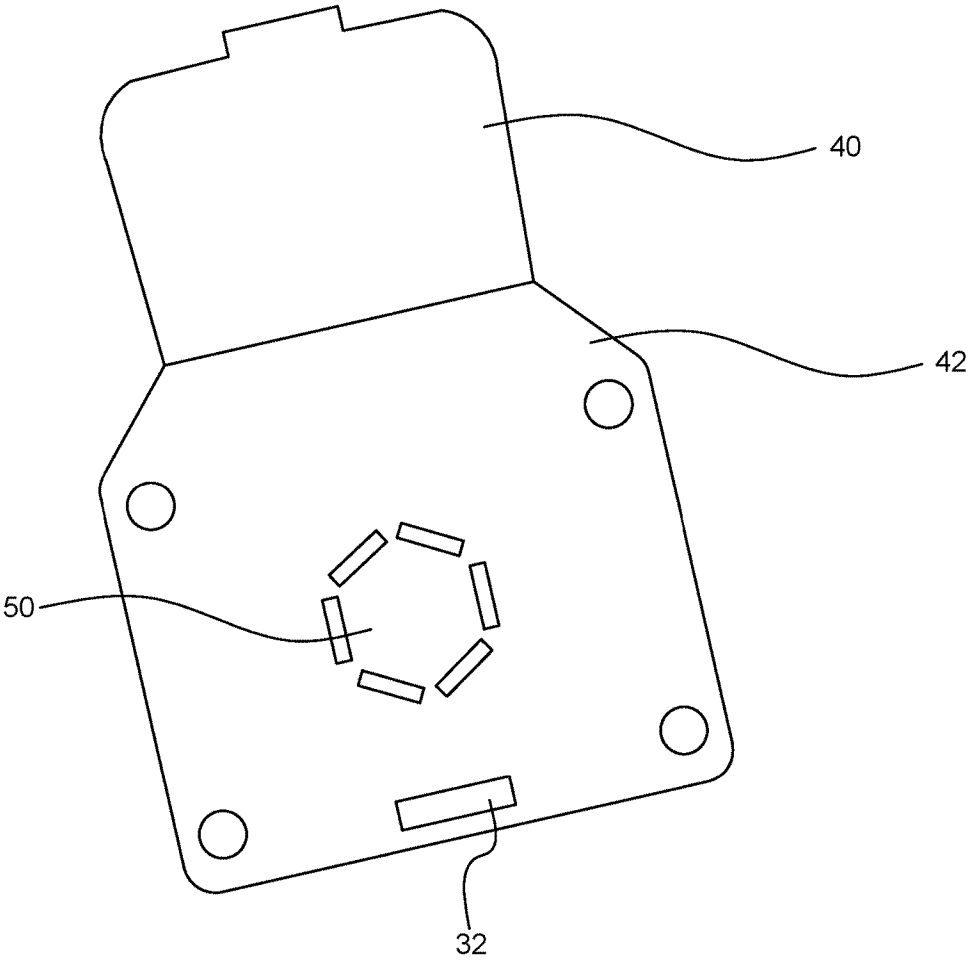
FIG. 4 depicts the plug connector with an exposed lid in accordance with the present invention.

A perspective view of the plug connector 100 is shown in FIG. 3 with a lid 40 close covering the connection module 50. This lid 40 is shown in an open position in FIG. 4 exposing the connection module 50 and provides exposure of the external connector 32. As a result a user may connect this plug connector into the RV or camper to activate exterior lighting associated with the connectors within the connection module 50. The external plug connector 100 clearly provides an alternative means for exterior lighting during a camping experience. The instant invention has been shown and described in what it considers to be the most practical and preferred embodiments. It is recognized, however, that departures may be made there from within the scope of the invention and that obvious modifications will occur to a person skilled in the art.

What is claimed is:

1. A RV plug connector for supplying exterior lighting comprising:

a. a lid;

b. a connector module, where the connector module is beneath the lid and provide a plurality of connectors related to RV lighting;

c. a plug, where the plug connects to a 12V DC adapter;

d. an external connector, where the external connector provides an outlet for any additional lighting; and e. a LED light above the lid, where the LED light illuminates the plug connector.

2. The RV plug connector according to claim 1, where the plurality of connectors includes a battery connector.

3. The RV plug connector according to claim 1, where the plurality of connectors includes a ground connector.

4. The RV plug connector according to claim 1, where the plurality of connectors includes a left turn and brake light connector.

5. The RV plug connector according to claim 1, where the plurality of connectors includes a tail and running light connector.

6. The RV plug connector according to claim 1, further including a toggle switch where the toggle switch activates lighting associated with the plurality of connectors.

* * * * *